US011353281B1

(12) United States Patent
Rentz

(10) Patent No.: US 11,353,281 B1
(45) Date of Patent: Jun. 7, 2022

(54) BACK-TENSION HANDHELD ARCHERY RELEASE

(71) Applicant: Gregory E. Summers, Madison Heights, VA (US)

(72) Inventor: Marc Rentz, Madison Heights, VA (US)

(73) Assignee: Gregory E. Summers, Madison Heights, VA (US), Trust Agreement Dated Dec. 8, 2006

( * ) Notice: Subject to any disclaimer, the term of this patent is extended or adjusted under 35 U.S.C. 154(b) by 0 days.

(21) Appl. No.: 17/370,510

(22) Filed: Jul. 8, 2021

(51) Int. Cl.
*F41B 5/18* (2006.01)
*F41B 5/14* (2006.01)

(52) U.S. Cl.
CPC ..... *F41B 5/1469* (2013.01)

(58) Field of Classification Search
CPC ..... F41B 5/1469
See application file for complete search history.

(56) References Cited

U.S. PATENT DOCUMENTS 5,694,915 A 12/1997 Summers
6,584,966 B1 * 7/2003 Summers ..... F41B 5/1469 124/35.2
6,631,709 B2 * 10/2003 Carter ..... F41B 5/1469 124/35.2
6,953,035 B1 * 10/2005 Summers ..... F41B 5/1469 124/35.2
8,622,051 B2 1/2014 Summers et al.
8,997,729 B1 * 4/2015 Gillig ..... F41B 5/1469 124/35.2
9,027,540 B2 * 5/2015 Springer ..... F41B 5/1469 124/90
9,599,428 B2 * 3/2017 Trpkovski ..... F41B 5/1469
9,702,658 B2 7/2017 Horn
9,970,731 B2 5/2018 Horn
10,436,544 B1 * 10/2019 Jones ..... F41B 5/1469
10,731,943 B2 8/2020 Horn
11,067,356 B2 * 7/2021 Haas ..... F41B 5/1469
2011/0168146 A1 * 7/2011 Deceuster ..... F41B 5/1469 124/80

* cited by examiner

*Primary Examiner* — John A Ricci
(74) *Attorney, Agent, or Firm* — Leading Edge Law Group, PLC

(57) ABSTRACT

A back-tension handheld archery release includes a handle and a sear assembly adjustably connected with the handle to lengthen and shorten a head release distance. The sear assembly includes a first sear and a click sear which is adjustable to control a click distance prior to firing a shot. In addition, the degree of rotation of the first and click sears relative to the head is adjustable to control the head speed of the sear assembly when the release is operated to release a bowstring and fire a shot.

16 Claims, 9 Drawing Sheets

BACK-TENSION HANDHELD ARCHERY RELEASE

BACKGROUND OF THE INVENTION

The present invention relates to an archery release, and more particularly to an adjustable back-tension handheld archery release for a bowstring.

Release devices are used in archery to assist the archer in pulling a bowstring to a fully drawn position and then releasing the bowstring to fire an arrow. Some release devices use grippers for engaging the bowstring or a hock mounted on the bowstring. Other release devices use a rope looped about the bowstring. Still other devices use back tension which eliminates the torque in looped rope releases. The present invention relates to a new handheld release which can be used in hinge style back tension, relax through the shot, constant motion, and increase pressure shooting methods.

BRIEF DESCRIPTION OF THE PRIOR ART

Back-tension release devices which reduce torque are well-known in the prior art as evidenced by U.S. Pat. No. 5,694,915. This patent discloses a back-tension rope release in which a catch for a rope loop is connected with a fork which in turn is connected with a handle. The orientation of the fork relative to the handle is adjustable in order to remove torque or twist from a rope loop. The catch is also adjustable relative to the fork in order to adjust the back-tension on the rope loop. Set screws are used to hold the fork and the catch in the desired positions.

Another back-tension release device is disclosed in U.S. Pat. No. 8,622,051 wherein an adjustable sear housing and an adjustable finger are provided. By adjusting the sear housing, twist or torque in a bowstring loop connected with the release can be eliminated. The speed of the release is altered via adjustment of the finger.

While the prior devices normally operate satisfactorily, they have limited adjustability both as to the release head length which is desired when an archer ties on a new D-loop but fails to tie it to the same length as the loop that is worn and being replaced and click sear distance which indicates to an archer when the release is about to fire.

SUMMARY OF THE INVENTION

The present invention was developed in order to overcome these and other drawbacks of prior archery releases by providing a handheld archery release which affords adjustment of the release head length and click sear distance. The release includes a handle having a longitudinal axis and a sear assembly adjustably connected with the handle for movement toward and away from the handle and operable between hold and fire positions upon pivotal movement of the handle to hold and release a bowstring. More particularly, the handle includes an opening, and the sear assembly includes a neck portion arranged in the handle opening. An adjustment screw is connected with the neck portion and is operable to move the neck portion relative to the handle. A neck locking screw is also provided to lock the sear assembly neck portion in a fixed position relative to the handle.

The sear assembly further includes a first sear pivotally connected with a head portion of the assembly at a remote end of the neck portion and a click sear pivotally connected with the head portion and coaxial with the first sear which is operable between hold and fire positions. The first and click sears both include a release edge configured to engage a bail configured to hold and release the bowstring. A torsion spring is arranged between the first and click sears to bias the first sear release edge and said click sear release edge away from each other. A click sear adjustment screw is threadably connected with one end of the click sear and engages a projection on the first sear. The click sear adjustment screw is operable to adjust an overlap distance between the release edges of the first and click sears to adjust a click length of the sear assembly. A click sear locking screw is also provided to lock the click sear adjustment screw in a fixed position.

A head adjustment screw is connected with the head portion of the sear assembly and engages the first and click sears to adjust the degree of rotation of the first and click sears relative to the head portion to control a release speed of the sear assembly.

BRIEF DESCRIPTION OF THE FIGURES

Other objects and advantages of the invention will become apparent from a study of the following specification when viewed in the light of the accompanying drawing, in which.

DETAILED DESCRIPTION

Figure 1:
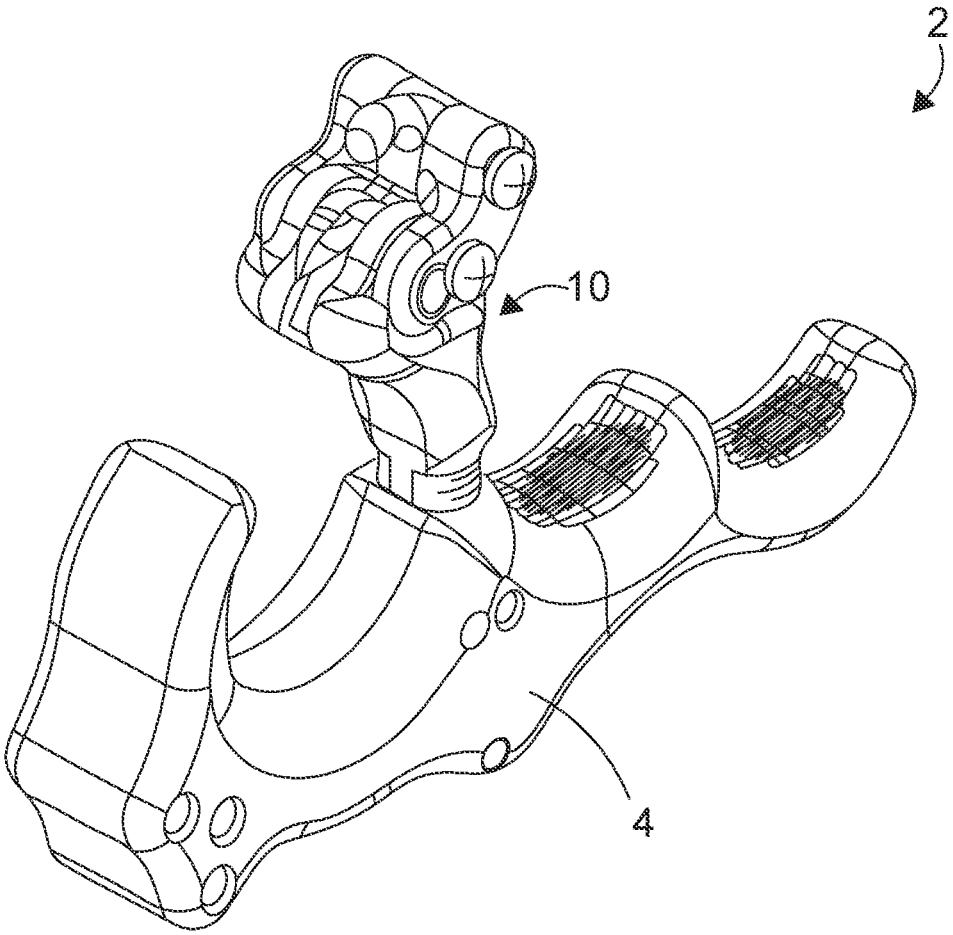
FIG. 1 is a perspective views of the back-tension handheld archery release according to the invention.

Referring to FIGS. 1-4, the back-tension handheld archery release includes a handle 4 having a longitudinal axis A. The upper surface of the handle includes a plurality of contours 6 which are configured to receive the fingers of an archer. Between the first and second contours, the handle contains a through opening 8. A sear assembly 10 is connected with the handle. More particularly, the sear assembly includes a neck portion 12 and a head portion 14 as shown more particularly in FIGS. 7-11. The neck portion contains a threaded opening 16 which receives an adjustment screw 18 which passes into the neck threaded opening via the handle through opening 8. Rotation of the adjustment screw 18 displaces the sear assembly relative to the handle to control the distance of the head portion 14 of the sear assembly relative to the handle to lengthen or shorten the release head length as shown in FIGS. 3 and 4*a-c*. FIGS. 4*a*, 4*b*, and 4*c* show the sear assembly in first, second, and third positions, respectively, with the head portion 14 being closest to the handle in the first position and farthest from the handle in the third position. The second position is between the first and third positions. While three positions are shown, it will be appreciated that the head portion can be positioned at any desired location relative to the handle between maximum and minimum spaced positions. The ability to lengthen and shorten the head length, the archer's preferred full draw length location or position is maintained for maximum accuracy.

To assist the archer with adjusting and re-adjusting the head portion of the sear assembly, the neck portion 12 includes indicia 20 such as gradations indicative of the location of the neck portion. It will be noted that in FIG. 4*a* where the head portion is closest to the channel, no indicia are visible whereas in FIGS. 4*b* and 4*c*, greater portions of indicia are visible as the head portion is displaced away from the handle.

Figure 3:
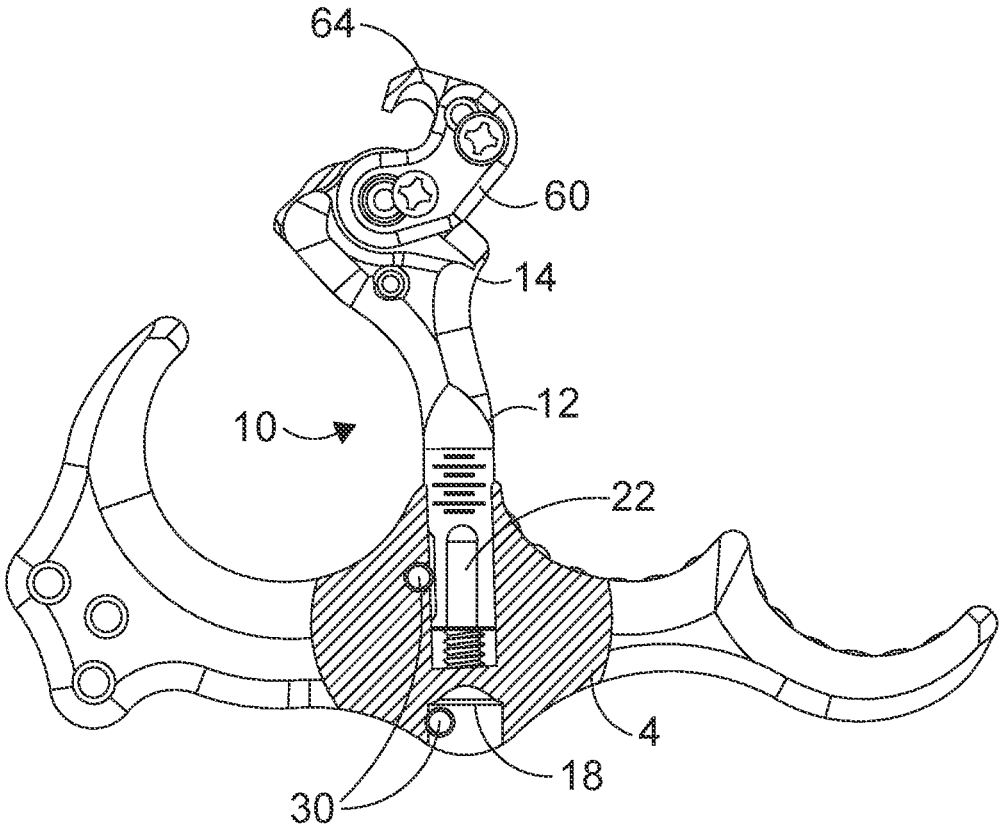
FIG. 3 is a partial sectional front view of the archery release.
Figure 4A:
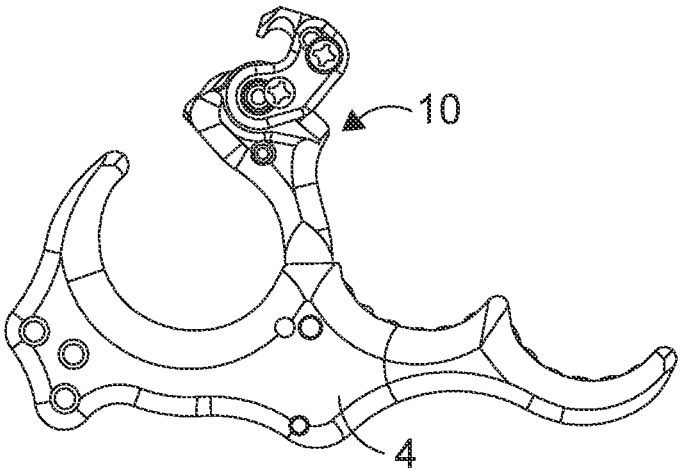
FIGS. 4*a*, 4*b*, and 4*c* are front views of the release with the sear assembly adjusted to increasing distances from the handle of the archery release, respectively.
Figure 4B:
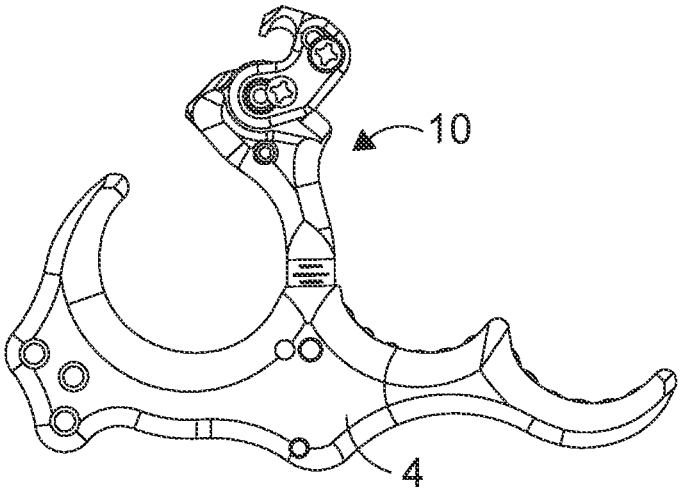
Figure 4C:
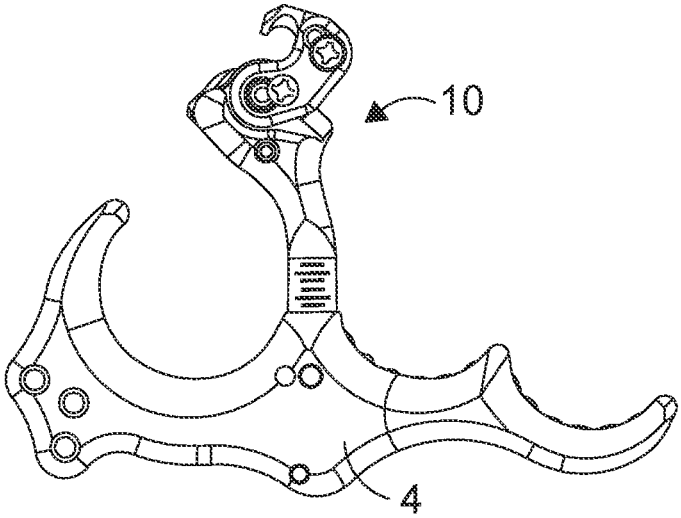
Figure 5:
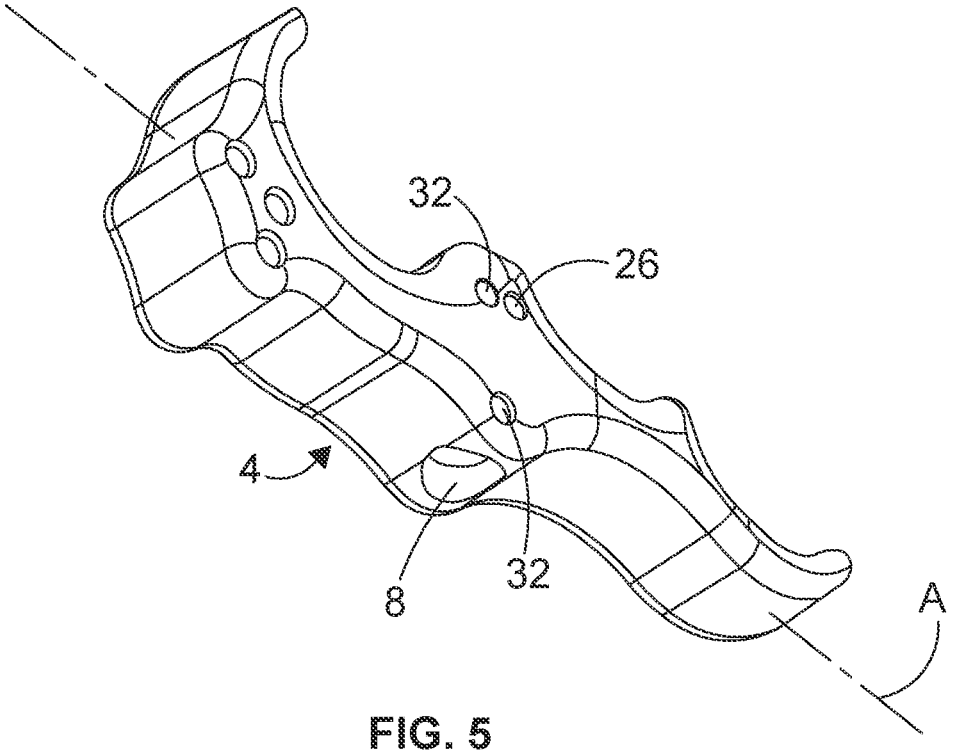
FIGS. 5 and 6 are top and bottom perspective views, respectively, of the handle of the archery release.
Figure 6:
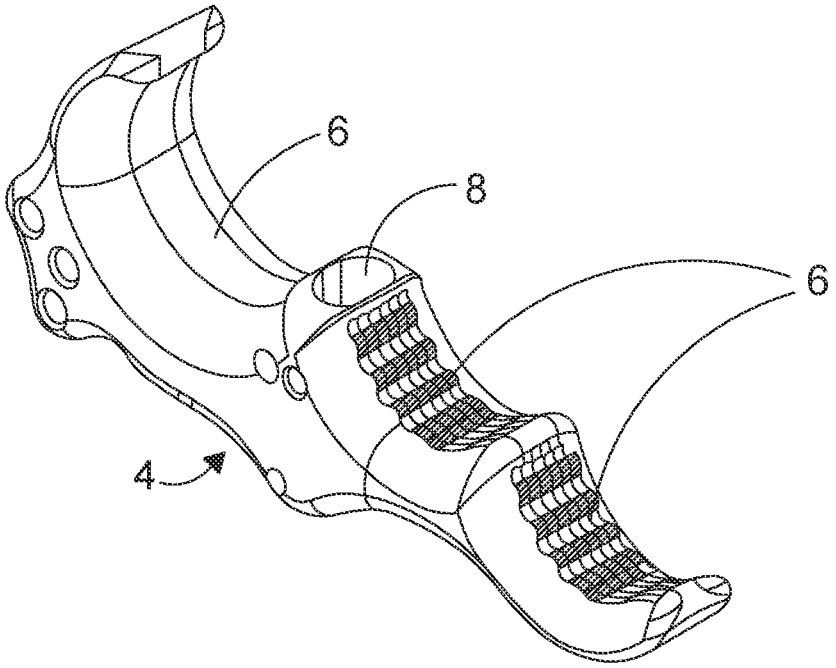
Figure 7:
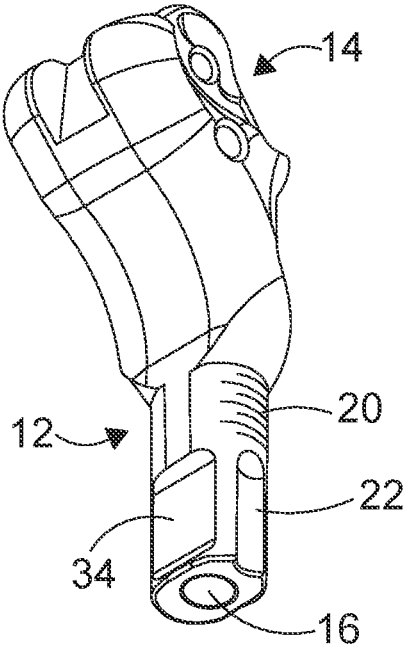
FIGS. 7 and 8 are bottom and top perspective views, respectively, of the neck and head portions of the sear assembly of the archery release.

In addition, the neck portion 12 contains a longitudinal track or channel 22 in the outer surface thereof. The indentation is configured to receive a synthetic plastic ball 24 which is arranged in an opening 26 in a side of the handle and which is held in place by a neck locking screw 28. Once the archer has adjusted the position of the head portion of the sear assembly with the adjustment screw 18, the sear assembly can be locked in place by tightening the neck locking screw against the ball 24 which presses against the channel 22 in the neck portion. A pair of dowel pins 30 are provided which fit snugly in corresponding openings 32 in the handle. The lower dowel pin retains the screw 18 relative to the handle and the upper dowel pin acts as a stop for movement of the sear assembly away from the handle as shown in FIG. 3. To that end, the outer surface of the neck portion 12 contains a flattened surface 34 of predetermined length against which the upper dowel pin abuts.

Figure 16:
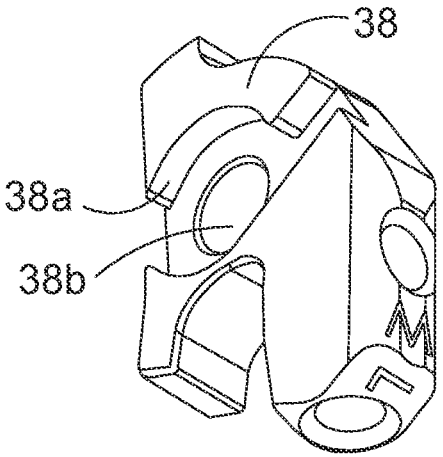
FIGS. 16 and 17 are front and rear perspective views, respectively, of a click sear of the sear assembly.
Figure 17:
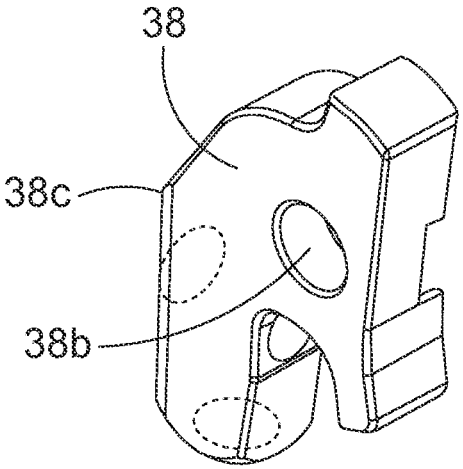

Other components of the sear assembly 10 will now be described. These components are shown in detail in FIGS. 12-18. More particularly, the sear assembly further includes a first sear 36 and a click sear 38 which are pivotally connected with the head portion 14 for movement about the same axis. The first sear 36 is shown in detail in FIGS. 12-15 and includes a depression 36*a* in one side surface, a central opening 36*b* within the depression, a first lateral projection 36*c* at one end, a second lateral projection 36*d* at a second end, and a release edge 36*e* on an outer surface thereof. The click sear 38 is shown in detail in FIGS. 16 and 17 and contains a depression 38*a* in one side surface, a central opening 38*b* within the depression, and a release edge 36*c* on an outer surface thereof. A torsion spring 40 is arranged between the first and click sears to bias the release edges of the sears away from each other.

Figure 2:
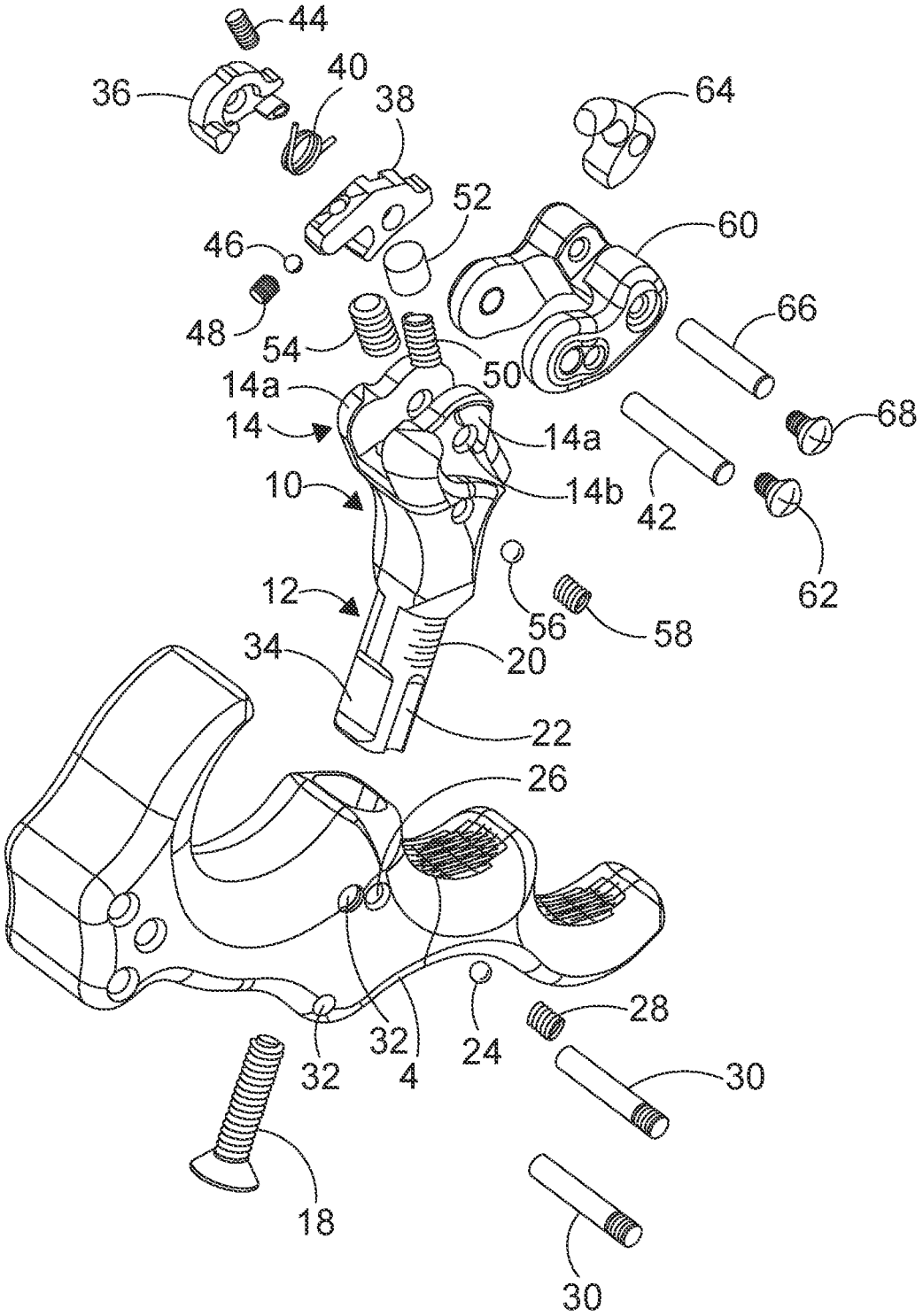
FIG. 2 is an exploded perspective view of the archery release.
Figure 8:
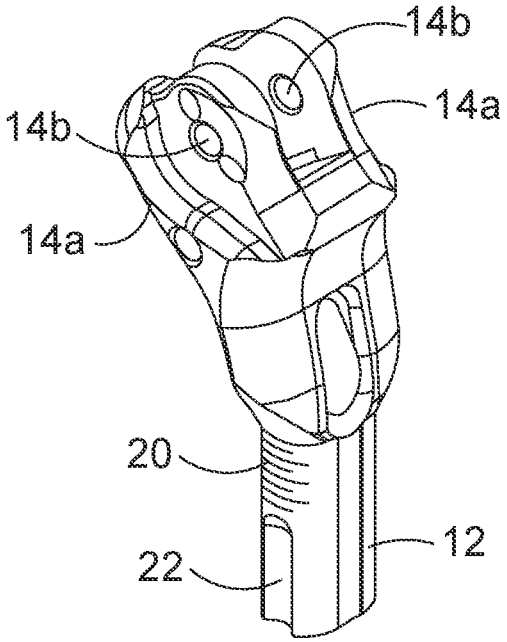
Figure 9:
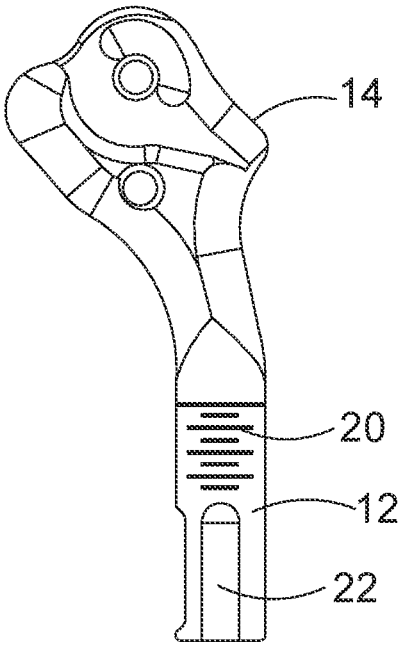
FIGS. 9, 10 and 11 are front, top and bottom views, respectively, of the neck and head portions of the sear assembly.
Figure 10:
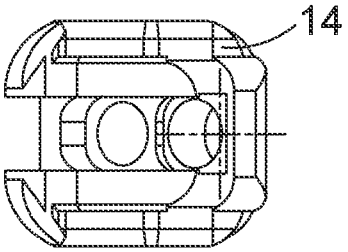
Figure 11:
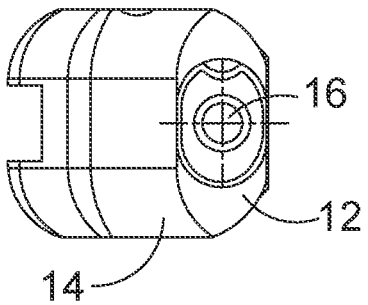
Figure 12:
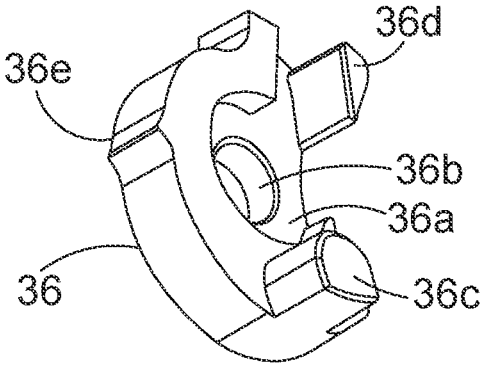
FIGS. 12 and 13 are front and rear perspective views, respectively, of a first sear of the sear assembly.
Figure 13:
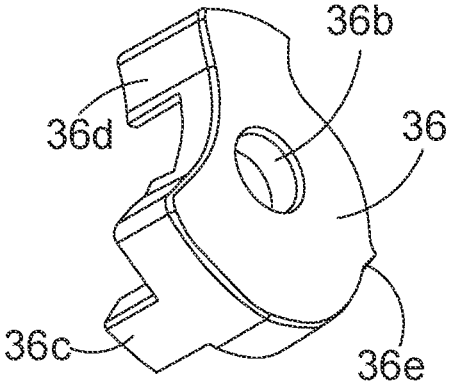
Figure 14:
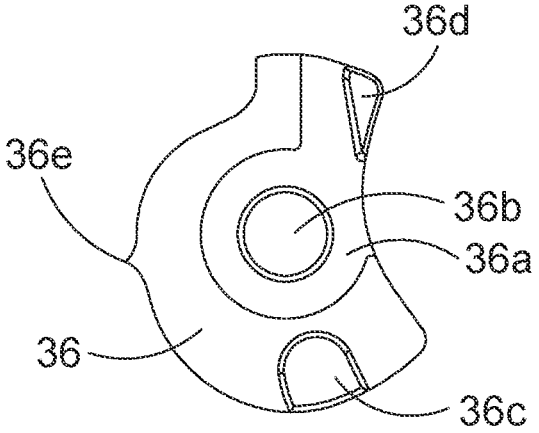
FIGS. 14 and 15 are front and right-side views, respectively, of the first sear of FIGS. 12 and 13.
Figure 15:
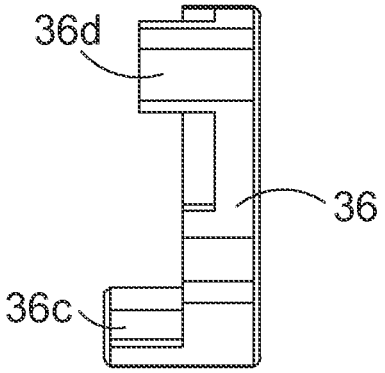

As shown in FIGS. 2 and 8, the head portion 14 of the sear assembly includes a pair of spaced projections 14*a* which contain aligned through openings 14*b*, respectively. A pivot pin 42 passes through an opening 14*b* in one of the head portion projections, the opening 38*b* of the click sear 38, a central opening of the torsion spring 40, the opening 36*b* of the first sear, and the opening 14*b* of the other head portion projection. The body of the torsion spring is arranged in the aligned depressions of the first and click sears which face one another, and the ends of the torsion spring extend from the depressions to bias the first and click sears in opposite directions relative to the dowel pin on which the sears pivot.

Figure 18:
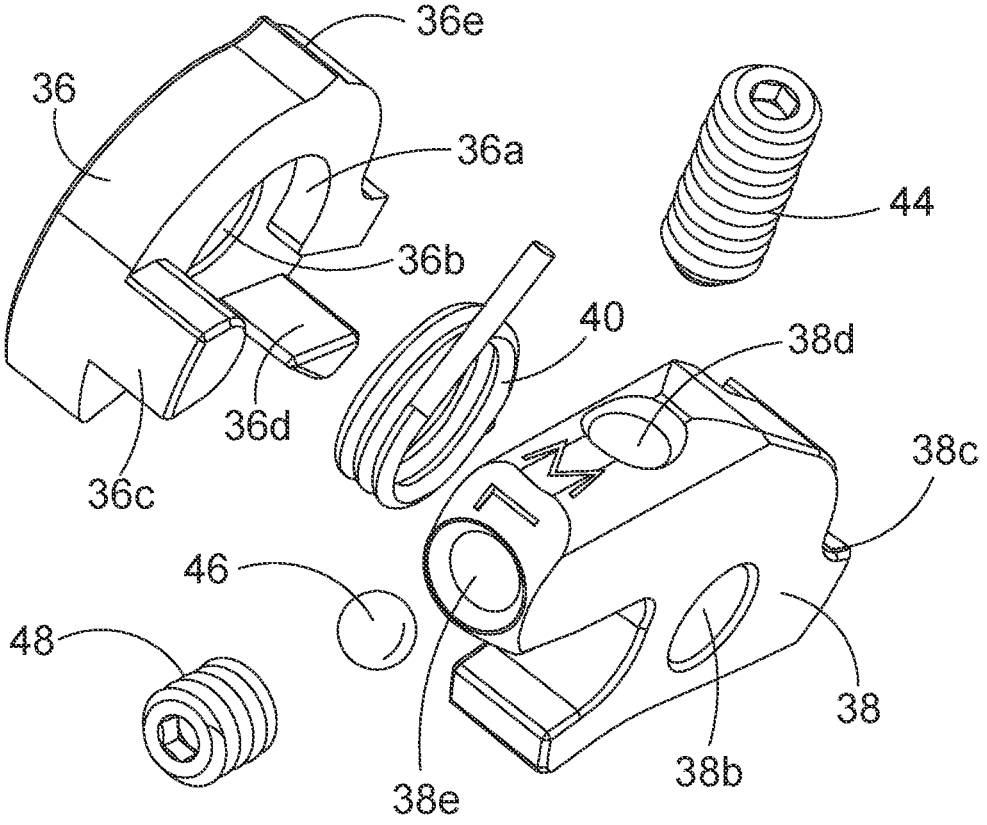
FIG. 18 is an exploded view of the first and click sears of the sear assembly.
Figure 22:
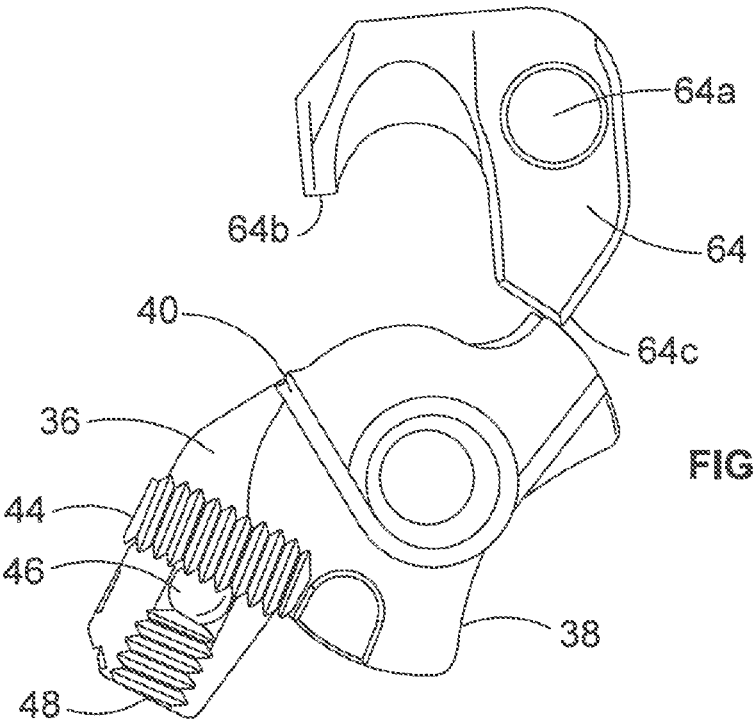
FIG. 22 is a detailed view of the engagement of release edges of the first and click sears and with the bail.

A unique feature of the sear assembly is that the click sear is adjustable. Referring to FIG. 18, the click sear includes a first threaded opening 38*d* which receives a click sear adjustment screw 44. One end of the screw engages the first lateral projection 36*c* of the first sear as shown in FIG. 22. Operation of the click sear adjustment screw pivots the click sear about the pivot pin 42 relative to the first sear with or against the force of the torsion spring. Accordingly, the release edge of the click sear is displaced relative to the release edge of the first sear to adjust an overlap distance between the release edges of the first and click sears in order to adjust the click length of the sear assembly as will be described in further detail below. Once the overlap distance is set by the click sear adjustment screw, the screw may be locked into place. For this purpose, the click sear 38 contains a second threaded opening 38*e* arranged at an angle relative to the first threaded opening 38*d*. A synthetic plastic ball 46 is arranged in the second threaded opening and pressed against the click sear adjustment screw by a click sear locking screw 48 also arranged in the second threaded opening.

Figure 21:
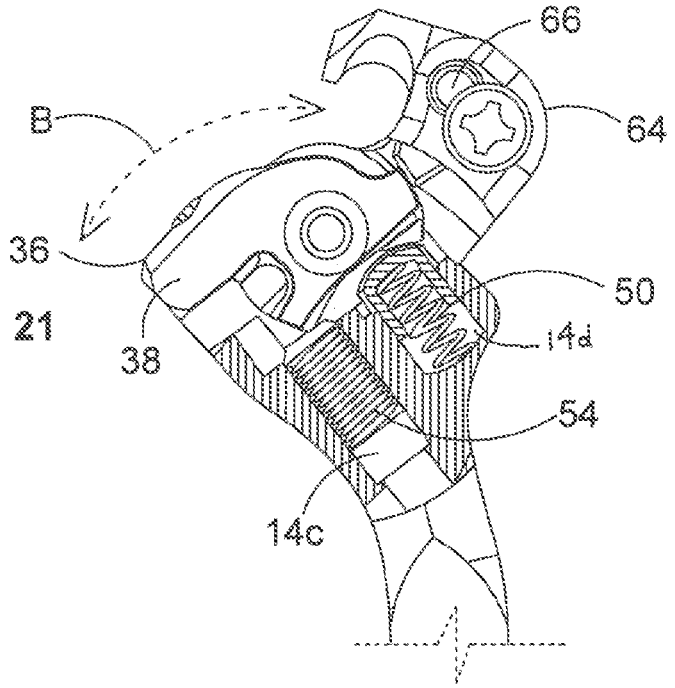
FIG. 21 is a sectional view of the head portion of the sear assembly including the cage and bail.

A further feature of the sear assembly is that the release speed of the assembly is also adjustable. Referring to FIGS. 2 and 21, the head portion 14 of the sear assembly 10 contains a threaded through opening 14*c* and a spaced parallel channel 14*d*. A spring 50 and spring cap 52 are arranged in the channel 14*d* to apply pressure to the sear assembly, and particularly to the first and click sears 36, 38. A head adjustment screw 54 is arranged in the threaded through opening 14*c* and engages the first and click sears to adjust the degree of rotation of the sears relative to the head portion and against the spring 50 as shown by the arrow B in FIG. 21. A synthetic plastic ball 56 and head adjustment locking screw 58 are arranged in a threaded opening in the head portion to lock the head adjustment screw 54 in a selected position and keep the head speed in adjustment.

Figure 19:
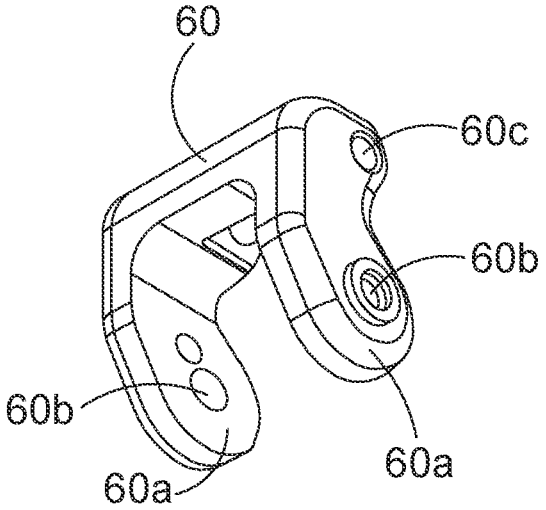
FIGS. 19 and 20 are bottom and top perspective views, respectively, of a cage for connection with the head portion of the sear assembly.
Figure 20:
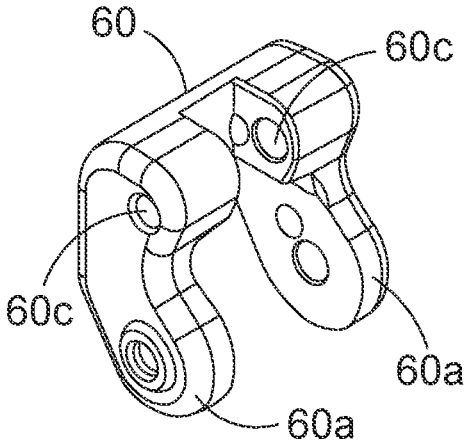

A cage 60 is pivotally connected with the head portion via the pivot pin 42. More particularly, as shown in FIGS. 19 and 20, the cage includes spaced legs 60*a* containing first aligned openings 60*b* for receiving the pivot pin 42, with the first sear 36 and the click sear 38 being arranged between the cage legs as shown in FIGS. 1 and 2. A head portion of a retaining screw 62 connected with the cage retains the pivot pin in position on the sear assembly.

A bail 64 is pivotally connected with the cage 60 via a pivot pin 66 which passes through a second pair of aligned openings 60*c* in the cage and an opening 64*a* in the bail. A further retaining screw 68 connected with the cage retains the bail pivot pin 66 in position. The bail has one end portion 64*b* configured to hold and release a bowstring and a release end portion 64*c* which engages the release edges of the first and click sears as shown in FIG. 22. Tension applied by the archer to the handle operates the sear assembly which is operable to hold and release the bail to in turn hold and release the bowstring.

The two piece sear assembly is operable to adjust the click distance, i.e. the distance between where the bail release end portion slides over the release edge of the slightly larger click sear and where the bail release end portion swivels slightly and drops down onto the first scar release edge, resulting in a metal to metal "click" noise that the archer listens for, so that the archer is somewhat aware when the release is close to firing. This click distance is adjustable by the archer using the click sear adjustment screw 44. Turning this screw causes the click sear release edge that the bail slides over to move farther or closer relative to the first sear release edge. The torsion spring 50 located between the sears supplies the pressure to keep the lateral projection of the first sear to stay in contact with the click sear adjustment screw.

The head adjustment screw 54 adjusts the amount the sears are able to rotate in the head, thereby adjusting where the location of the sear release edges are in relation to the handle. When the handle is hinged or rotated during back tension to fire a shot, the bail falls over the adjustable sear release edge with the shot being fired at different handle angles. The head adjustment screw 54 is turned clockwise, moving the sear release edge down or closer to the pinky side of the handle for a faster shot so that less handle rotation is necessary for the bail to fall over the sear release edge to fire the shot. Turning the head adjustment screw in the counter-clockwise direction raises the sear release edge that the bail slides over, resulting in a slower speed as it takes more handle rotation for the bail to fall over the sear edge and fire the shot. The small cap over the spring remains in contact with the first and click sears providing the necessary pressure to keep the sears in contact with the head adjustment screw. The archer's hinging handle movement additionally pressures the sears to move in that rotation direction, keeping the sears in contact with the head adjustment screw during the back-tension hinging firing sequence.

While the preferred forms and embodiments of the invention have been illustrated and described, it will become apparent to those of ordinary skill in the art that various changes and modifications may be made without deviating from the inventive concepts set forth above.

What is claimed is:

1. An archery release, comprising (a) a handle having a longitudinal axis and containing an opening;

(b) a sear assembly adjustably including a neck portion arranged within said handle opening for movement toward and away from said handle and operable between hold and fire positions upon pivotal movement of said handle to hold and release a bowstring, respectively; and (c) a neck locking screw connected with said handle to lock said sear assembly neck portion relative to said handle.

2. An archery release as defined in claim 1, and further comprising an adjustment screw connected with said neck portion and operable to move said neck portion relative to said handle.

3. An archery release as defined in claim 2, wherein said sear assembly includes a head portion at an end of said neck portion spaced from said handle.

4. An archery release as defined in claim 3, wherein said sear assembly further includes (a) a first sear pivotally connected with said head portion; and (b) a second sear pivotally connected with said head portion and coaxial with said first sear, said first and second sears being operable between hold and fire positions.

5. An archery release as defined in claim 4, and further comprising a torsion spring arranged between said first and second sears to bias said first and second sears toward the hold position.

6. An archery release as defined in claim 5, and further comprising a sear adjustment screw threadably connected with one end of said second sear and operable to adjust an overlap distance between said first and second sears, thereby to adjust the fire position of said sear assembly.

7. An archery release as defined in claim 6, and further comprising a click sear locking screw connected with said second sear to lock said sear adjustment screw in a fixed position.

8. An archery release as defined in claim 6, wherein said head portion contains a recess adjacent to a second end of said second sear and further comprising a spring arranged in said head portion recess to bias said second sear against said sear adjustment screw.

9. An archery release as defined in claim 6, and further comprising a cage rotatably connected with said sear assembly head portion and a bail rotatably connected with said cage, said bail having one end configured to hold and release the bowstring and another end which engages said second sear, whereby said sear assembly is operable to hold and release said bail to hold and release the bowstring, respectively.

10. An archery release as defined in claim 5, and further comprising a head adjustment screw connected with said head portion and engaging said second sear to limit the rotation of said second sear relative to said head portion, thereby to control the speed of said sear assembly.

11. A sear assembly for an archery release, comprising (a) a head portion;

(b) a first sear pivotally connected with said head portion;

(c) a second sear pivotally connected with said head portion and coaxial with said first sear, said first and second sears being operable between hold and fire positions; and (d) a torsion spring arranged between said first and second sears to bias said first and second sears toward the hold position.

12. A sear assembly as defined in claim 11, and further comprising a sear adjustment screw threadably connected with one end of said second sear and operable to adjust an overlap distance between said first and second sears, thereby to adjust the fire position of said sear assembly.

13. A sear assembly as defined in claim 12, and further comprising a click sear locking screw connected with said second sear to lock said sear adjustment screw in a fixed position.

14. A sear assembly as defined in claim 12, wherein said head portion contains a recess adjacent to a second end of said second sear and further comprising a spring arranged in said head portion recess to bias said second sear against said sear adjustment screw.

15. A sear assembly as defined in claim 12, and further comprising a cage rotatably connected with said head portion and a bail rotatably connected with said cage, said bail having one end configured to hold and release the bowstring and another end which engages said second sear, whereby said sear assembly is operable to hold and release said bail to hold and release the bowstring, respectively.

16. A sear assembly as defined in claim 11, and further comprising a head adjustment screw connected with said head portion and engaging said second sear to limit the rotation of said second sear relative to said head portion, thereby to control the speed of said sear assembly.

* * * * *